United States Patent [19]

Buyofsky et al.

[11] Patent Number: 4,693,922

[45] Date of Patent: Sep. 15, 1987

[54] LIGHT WEIGHT ENTANGLED NON-WOVEN FABRIC HAVING EXCELLENT MACHINE DIRECTION AND CROSS DIRECTION STRENGTH AND PROCESS FOR MAKING THE SAME

[75] Inventors: Conrad C. Buyofsky, South River; John W. Kennette, Somerville, both of N.J.

[73] Assignee: Chicopee, New Brunswick, N.J.

[21] Appl. No.: 780,461

[22] Filed: Sep. 26, 1985

[51] Int. Cl.[4] ..... B32B 3/10; D06C 1/46; D06C 1/74

[52] U.S. Cl. ..... 428/134; 28/105; 28/106; 428/179; 428/187; 428/195; 428/224

[58] Field of Search ..... 428/134, 179, 187, 195, 428/224; 28/105, 106

[56] References Cited

U.S. PATENT DOCUMENTS

| | | | |
|---|---|---|---|
| 3,081,515 | 3/1963 | Griswold et al. | 428/224 |
| 4,016,319 | 4/1977 | Marshall | 428/113 |
| 4,095,007 | 6/1978 | Marshall | 428/113 |
| 4,379,799 | 4/1983 | Holmes et al. | 428/296 |
| 4,440,819 | 4/1984 | Rosser et al. | 428/107 |
| 4,612,226 | 9/1986 | Kennette et al. | 428/134 |

*Primary Examiner*—James C. Cannon

[57] ABSTRACT

A light weight entangled nonwoven fabric formed by fluid rearrangement/entangling of an oriented web of fibers comprising at least 75% polyester staple fibers, and displaying excellent machine direction and cross direction strength.

5 Claims, 16 Drawing Figures

LIGHT WEIGHT ENTANGLED NON-WOVEN FABRIC HAVING EXCELLENT MACHINE DIRECTION AND CROSS DIRECTION STRENGTH AND PROCESS FOR MAKING THE SAME

The invention relates to a light weight entangled non-woven fabric that has excellent strength in both the machine and cross direction and to a process for producing it.

BACKGROUND OF THE INVENTION

The fluid rearrangement and entangling of fibers to produce non-woven fabrics has been commercially practiced for many years. See for instance, Kalwaites, U.S. Pat. Nos. 2,862,251 and 3,033,721; Griswold et al., U.S. Pat. No. 3,081,500; Evans, U.S. Pat. Nos. 3,485,706; and Bunting et al., U.S. Pat. No. 3,493,462. This basic technology has been used to produce a wide variety of non-woven fabrics.

U.S. Pat. No. 3,486,168 discloses an unapertured ribbed entangled non-woven fabric. The fibers are supported on a "grill" during entangling. In one embodiment the fabric comprises parallel entangled ribs with a substantially continuous array of fibers extending between the ribs. U.S. Pat. No. 3,498,874 discloses an apertured ribbed entangled non-woven fabric. During entangling the fibers are supported on a plain weave carrier belt having heavier wires or filaments in one direction and three to five times as many finer wires or filaments extending in the other direction. The fabric formed thereon displays zig-zag entangled ribs extending in said one direction.

Co-pending application Ser. No. 602,877 filed Apr. 23, 1984, and now U.S. Pat. No. 4,612,226, discloses an apertured entangled non-woven fabric comprising two series of fibrous bands that are substantially perpendicular to each other. Each band contains segments in which the individual fibers are substantially parallel to each other, these segments alternate with regions of entangled fibers which occur when the band of one series intersects a band of the other series. The fabric is entangled on a plain weave belt.

U.S. Pat. No. 4,379,799 to Holmes et al. utilizes fluid rearrangement and entanglement to provide a non-woven fabric having the appearance of ribbed terry cloth, by carrying out the fluid rearrangement/entanglement on a woven belt having fine threads or filaments extending in one direction and fine threads or filaments and heavier threads extending in the other direction. The non-woven fabric provided therein is characterized by a repeating pattern of spaced, paralleled, raised ribs which extend continuously in one fabric direction, with the ribs being interconnected by spaced bundles of straight, substantially parallel fiber segments, said bundles being substantially parallel to one another and substantially perpendicular to said ribs. Adjacent bundles and the ribs they interconnect form apertures. The fibers in the ribs are almost wholly entangled throughout. On a macroscopic scale when viewing the fabric as a whole, the ribs are uniform and substantially non-patterned. The fabric of Holmes et al. are described as having typical basis weights of 1.5 oz. to 6 oz. per square yard.

The fabric of the present invention is made on the particular type of carrier belt described in Holmes et al. The fabric of the present invention have a basis weight of from 0.03 to 1.5 oz/yd$^2$. They are made from a starting web of carded fibers comprising at least 75% polyester staple fibers. While the fabrics of the present invention do not display ribs which are almost wholly entangled throughout, they exhibit excellent strength in both the machine and cross direction.

SUMMARY OF THE INVENTION

The fabric present invention comprises a light weight entangled non-woven fabric having an excellent combination of machine direction and cross direction strength. The fabric comprises at least 75% polyester staple fibers. The fabric is characterized by a repeating pattern of spaced, parallel, lines of raised regions of entangled fibers interconnected by an array of partially entangled fibers, said lines extending substantially transversly of said fabric. The raised regions of entangled fiber of one line are interconnected to raised regions of entangled fiber in an adjacent line, by spaced bundles of straight substantially paralleled fiber segments, said bundles being substantially parallel to one another and substantially perpendicular to said lines. Adjacent bundles, and the lines of raised entangled fiber regions and partially entangled fiber arrays they interconnect form aperatures.

The fabric of the invention is produced by a process which comprises:

(a) Supporting a layer of fibers comprising at least 75% polyester staple fibers, having a basis weight of 0.03 to 1.5 oz/yd$^2$, on a liquid pervious support member adapted to move in a predetermined direction and on which fiber movement in directions both in and at an angle to the plane of said layer is permitted in response to applied liquid forces, the fibers of said layer being oriented in said predetermined direction, and said support member having alternating liquid impervious deflecting zones and liquid pervious entangling zones extending transversely to said predetermined direction, said deflecting zones including spaced deflecting means adapted to deflect liquid in a direction transverse to said predetermined direction;

(b) moving the supported layer in said predetermined direction through a fiber rearranging zone within which streams of high pressure, fine, essentially columnar jets of liquid are projected directly onto said layer; and (c) passing said stream of liquid through said layer and said support member in said fiber rearranging zone to effect movement of fibers such that (1) spaced bundles of straight, substantially paralleled fiber segments are formed in said deflecting zones, said bundles being oriented generally in said predetermined direction, (2) spaced, parallel lines of raised entangled fiber regions interconnected by partially entangled fiber arrays are formed in said entangling zones, said lines extending in a direction transverse to said predetermined direction, and (3) said spaced bundles interconnect said entangled regions and are locked into said entangled regions at the ends of said bundles by fiber entanglement.

BRIEF DESCRIPTION OF THE DRAWINGS

FIGS. 8 and 10 are photomacrographs of the fabric of the present invention taken at 10X, showing the top side and the belt side, respectively, illuminated from above.

DETAILED DESCRIPTION OF THE INVENTION

Figure 1:
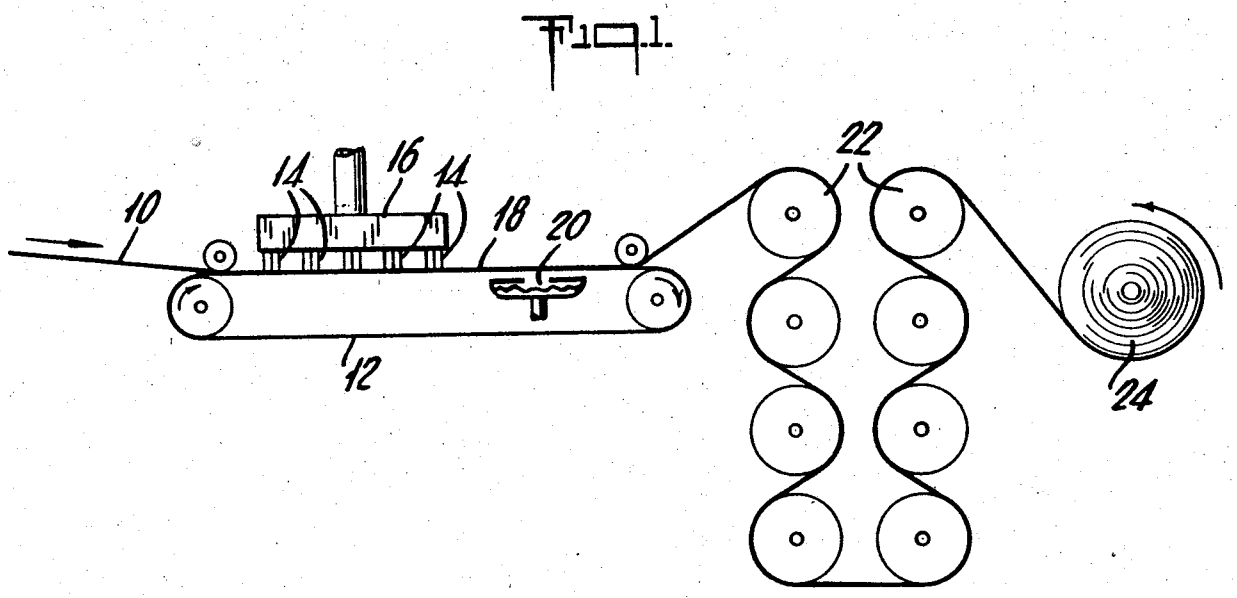
FIG. 1 is a schematic side elevation of an apparatus that can be used to manufacture the fabrics of the present invention.

The non-woven fabric of this invention is produced by the fluid rearrangement/entanglement of a layer of fibers on a liquid pervious woven forming belt of special construction which is described more fully below. As shown in FIG. 1 a fibrous layer 10 of stable fibers can be passed onto an endless belt 12 which is the said woven forming belt. The belt 12 carries the layer of fibers 10 under a series of high-pressure fine, essentially columnar jets of water 14. The high-pressure water is supplied from a manifold 16. The jets 14 are arranged in rows disposed transversely across the path of travel of the forming belt 12. Preferably, there is a vacuum slot (not shown) pulling a vacuum of e.g., 2 to 15 inches of water, beneath the forming belt 12, directly under each row of jets 14 in order to optimize durability of the fabric product. The fibers in the layer 10 are rearranged and entangled by the jets 14 as the liquid from the jets 14 passes through the fiberous layer 10 and then passes through or rebounds from the belt 12, to form the fabric 18 of the present invention. The fabric 18 is carried by the belt 12 over a vacuum dewatering station 20, and then proceeds to a series of drying cans 22 and from there to a windup 24.

Evans, in U.S. Pat. No. 3,485,706 describes a process an apparatus for rearranging/entangling fiberous webs by carrying fibrous layers on a woven belt under a series of high pressure, fine, columnar jets of liquid. The disclosure of Evans is incorporated herein by reference.

In forming the fabrics of the present invention, staple fibers are used, that is fibers having length of from about ½ up to about 3 inches. The belt speeds, water jet pressures, and number of rows of jets have not been found to be narrowly critical. Representative conditions are the following:

Belt speed: About 3 to 300 ft. per minute

Jet pressurer: About 200 to 2000 psi

Rows of jets: About 2 to 50

The forming belt used to make the fabrics of the present invention is woven from fine warp monofilaments which extend in the direction of travel of the belt, or the machine direction, and fill monofilaments of 2 different sizes; a heavier fill monofilament and a finer fill monofilament. The belt is woven in such a manner that the topography of the top surface of the belt, that is, the surface which the fibers will contact, has raised parallel ridges alternating with the depressions. The raised ridges are formed by the heavier fill monofilaments. At spaced intervals along said heavier fill monofilaments, fine warp monofilaments pass over the heavier fill monofilaments. The weave of the forming belt is such that at least 2, and up to 4, of the warp monofilaments pass under each heavier fill monofilament between each warp monofilament that passes over the heavier fill monofilament. Therefore, the intervals between said fine warp monofilaments that pass over the heavier fill monofilaments will usually vary from about 2 to about 4 diameters of the fine warp monofilaments. In said depressions, warp filaments are interlaced with fine fill monofilaments to provide a relatively tightly closed, but still water pervious zone. The forming belts used in the present invention are disclosed in U.S. Pat. No. 4,379,799.

Figure 2:
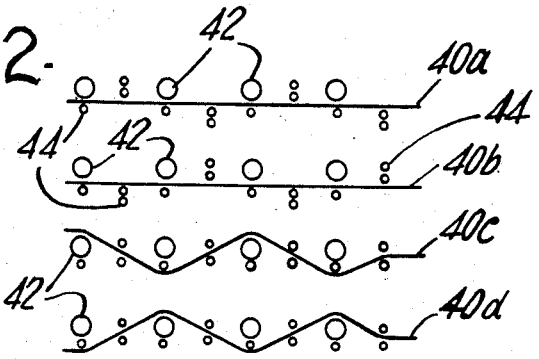
FIGS. 2 and 3 are schematic cross-sections through four successive warps of forming belts which may be used to make the fabrics of the present invention.

In the examples, below, two different forming belts were used to form the fabrics of the present invention. Their description is as follows:

Forming belt A—80 warp ends per inch by 26 picks per inch. Schematic cross-sections through 4 consecutive warps 40*a*, 40*b*, 40*c*, and 40*d* are shown in FIG. 2. The pattern repeats after 4 warps. The warps are 0.01 inch polyester monofilaments, and the two different sized filling threads are 0.04 inch polyester monofilaments 42 and 0.016 inch polyester monofilaments 44.

Figure 3:
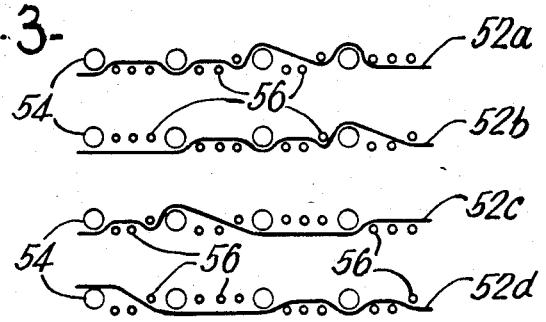

Forming belt C—60 warp ends per inch by 20 picks per inch. Schematic cross-sections through 4 successive warps 52*a*, 52*b*, 52*c*, and 52*d* are shown in FIG. 3. The pattern repeats after 4 warps the warps were 0.06 inch polyester monofilaments, and the two different sized filling threads are 0.04 inch polyester monofilaments 54 and 0.01 inch polyester monofilaments 56.

As described in U.S. Pat. No. 4,379,799 fabrics formed on such a forming belt typically have the appearance of ribbed terrycloth, and are characterized by a repeating pattern of spaced parallel raised ribs which are substantially wholly entangled throughout and appear uniform and substantially non patterned. The fabrics as described in the patent have typical fabric weights of 1½ to about 6 ounces per square yard. Applicants have now discovered that at weights below about 1½ ounces per square yard starting layers of oriented fibers do not produce the fabric described in the patent in that they do not have continuous entangled ribs. These fabrics, however, have surprising strength in both the machine and cross direction.

Figure 4:
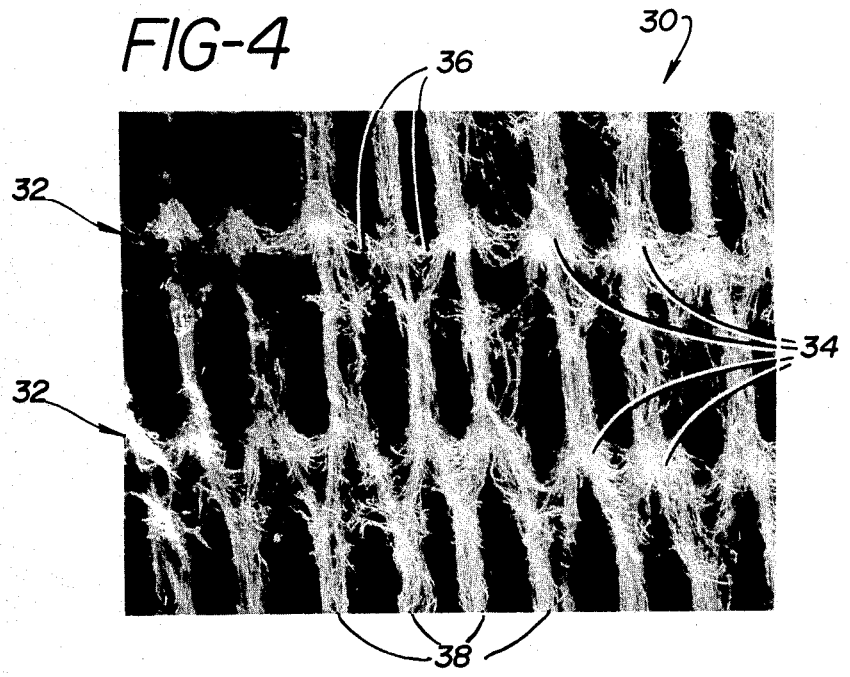
FIGS. 4 and 5 are photomacrographs of the fabric of the present invention taken at 10X, showing the top side and the belt side, respectively, illuminated from above.
Figure 5:
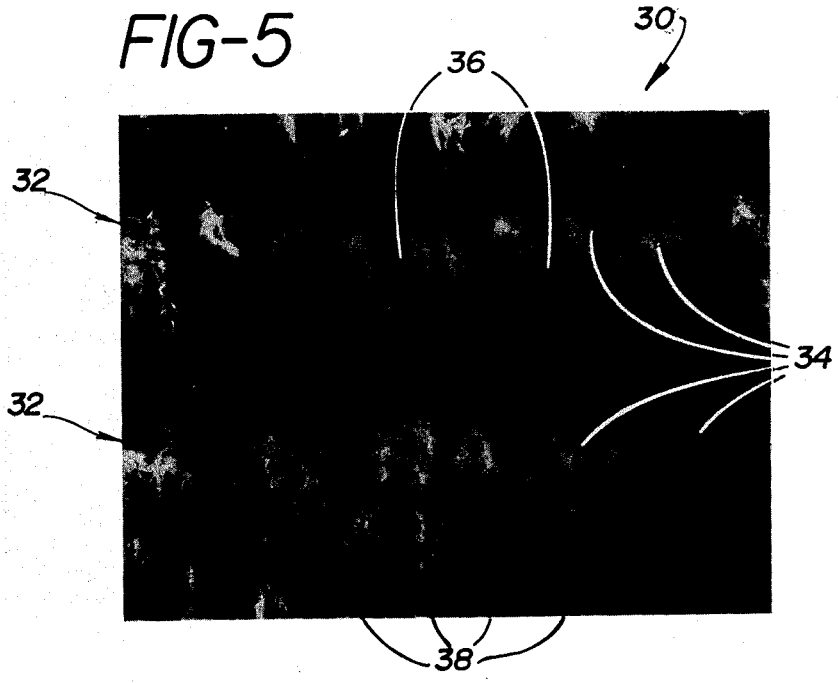
Figure 6:
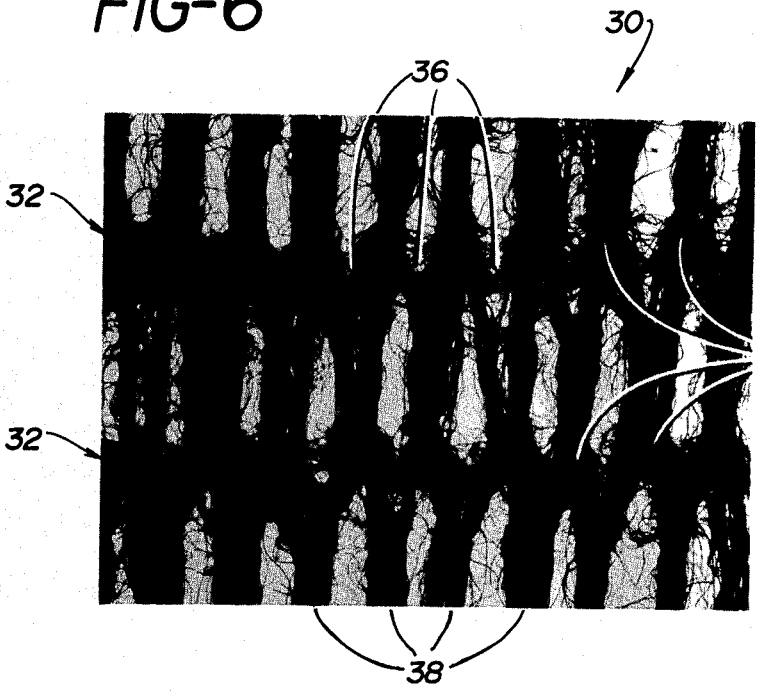
FIG. 6 is a photomacrograph of the fabric of FIGS. 4 and 5, taken at 10X, showing the top side of the fabric, illuminated from below.

FIGS. 4 to 6 are the present application show a 1 ounce per square yard fabric made with a carded web on forming belt C. The starting web and fabric comprise 75% Celanese 310 1.5 denier, 1⅛ inch staple polyester fibers and 25% ENKA 8172 1.5 denier, 1¼ inch rayon staple fibers. The fibrous layer, atop belt C, was wet out and then passed under a manifold containing three orifice strips. The orifice strips contained a row of holes, 30 holes per inch of 0.007 inch diameter, through which the water jetted. The three strips were operated at 550 psig. The fabric shown generally at 30 has discontinuous ribs 32 comprising a line of raised and tangled fiber regions 34 interconnected by partially entangled fiber arrays 36. The raised entangled regions of adjacent lines are interconnected by bundles 38 of straight substantially parallel unentangled fibers. The lines 32 of entangled fiber regions are substantially parallel to one another, and the bundles 38 are substantially paralleled to each other and substantially perpendicular to the lines 32. In the fluid rearrangement/entangling process, the interconnecting bundles are formed in the intervals between the wrp monofilaments that pass over the heavier fill monofilaments. The jets of liquid 14 (FIG. 1) strike these warp monofilaments and are deflected transversely to "wash" the fibers into the said intervals. The fibers are then oriented in a direction parallel to the warp monofilaments by the action of the liquid as it is also deflected by the heavier fill monofilaments. The spaces between the heavier fill monofilaments comprise entangling zones wherein are formed the lines of raised entangled fiber regions interconnected by partially entangled arrays of fibers.

Figure 7:
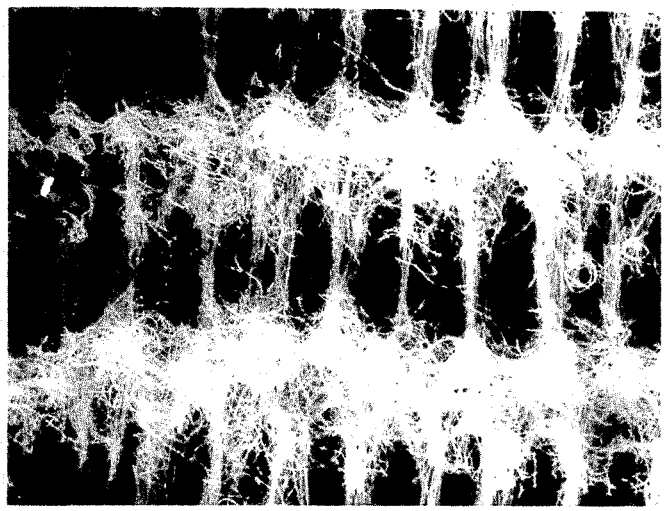
FIGS. 7 and 8 are photomacrographs of the prior art fabrics taken at 10X, showing the top side and the belt side respectively, illuminate from above.
Figure 8:
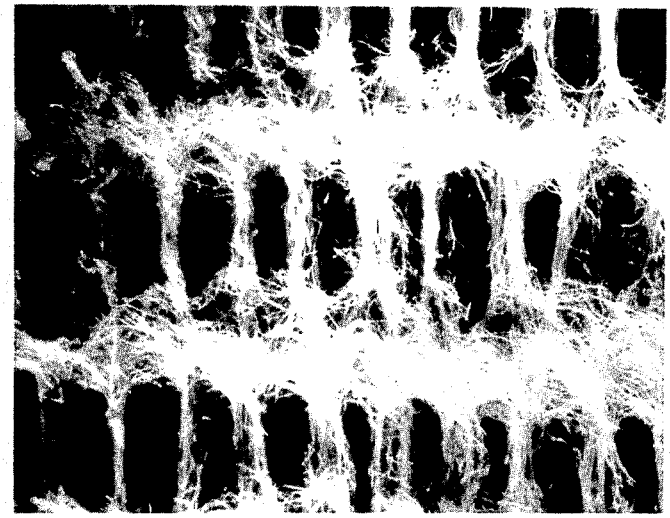

FIGS. 7 and 8 disclose a 1 ounce per square yard entangled fabric made from a random web of fibers on forming belt C. As can be seen clearly in these photomacrograph, the fabric comprises a repeating pattern of spaced parallel raised ribs of entangled fibers interconnected by spaced bundles of straight unentangled substantially parallel fiber segments as described and claimed in U.S. Pat. No. 4,379,799. The web and final fabric comprise the same fiber composition as the fabric set forth in FIGS. 4 through 6 of the present application, namely 75% polyester and 25% rayon, and were entangled under the same conditions. Table 1, below, sets forth the fabric strength in terms of tenacity in both the machine direction and cross direction of the fabric of FIGS. 4 through 6 and the fabric of FIGS. 7 and 8. The tenacities, expressed in #1b/in per 100 grains of fabric sample weight were calculated from the grab tensile of the fabric samples tested according to ASTM D-1682-64.

TABLE I

| Fiber | Web | Belt | MD Tenacity | CD Tenacity |
|---|---|---|---|---|
| 75% PET/ 25% Rayon | Oriented | C | 3.0 | .64 |
| 75% PET/ 25% Rayon | random | C | 2.6 | 2.0 |

The discontinuous ribbed fabrics of the present invention, made by fluid arrangement/entanglement of a light weight oriented web supported on the forming belts described herein display increased machine direction tenacity and cross direction tenacity over other entangled apertured fabrics at 75% or more polyester fibers. Table II below sets forth the relative machine direction and cross direction tenacity for fabrics formed on forming belt C and on a 20×20 belt and a 12×12 belt, at various fiber compositions. The 20×20 belt comprises a plain weave belt of 20 warp ends per inch and 20 pick ends per inch of 0.02 inch polyester warp monofilaments and 0.02 inch polyester fill monofilaments. The 12×12 belt comprises a plain weave of 11 warp ends per inch and 15 pick ends per inch of 0.03 inch polyester warp monofilaments and 0.03 inch polyester fill monofilaments.

TABLE II

| Fiber | Web | Belt | MD Tenacity | CD Tenacity |
|---|---|---|---|---|
| 100% PET | Oriented | C | 4.1 | .99 |
| | | 20 × 20 | 2.1 | .25 |
| | | 12 × 12 | 2.0 | .24 |
| 75% PET 25% Rayon | Oriented | C | 3.0 | .64 |
| | | 20 × 20 | 1.8 | .29 |
| | | 12 × 12 | 2.4 | .39 |
| 50% PET/ 50% Rayon | Oriented | C | 3.2 | .75 |
| | | 20 × 20 | 2.8 | .47 |
| | | 12 × 12 | 3.3 | .73 |
| 100% Rayon | Oriented | C | 2.2 | .60 |

TABLE II-continued

| Fiber | Web | Belt | MD Tenacity | CD Tenacity |
|---|---|---|---|---|
| | | 20 × 20 | 2.2 | .53 |
| | | 12 × 12 | 2.3 | .69 |

Figure 11:
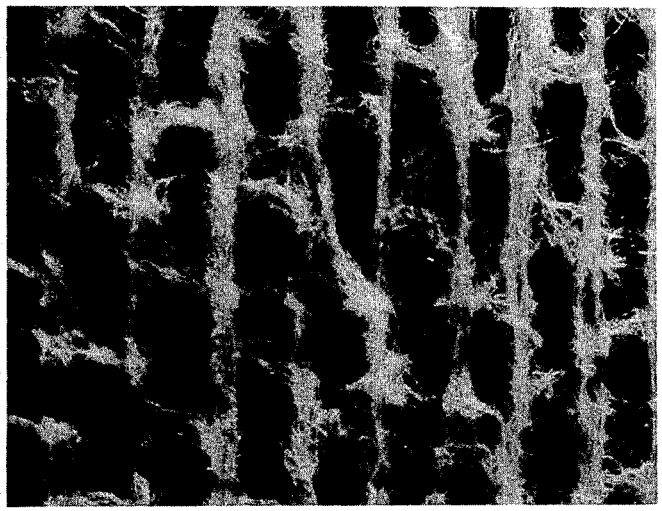
FIGS. 11 and 12 are photomacrographs of prior art fabrics taken at 10X, showing the top side and the belt side respectively, illuminated from above.
Figure 12:
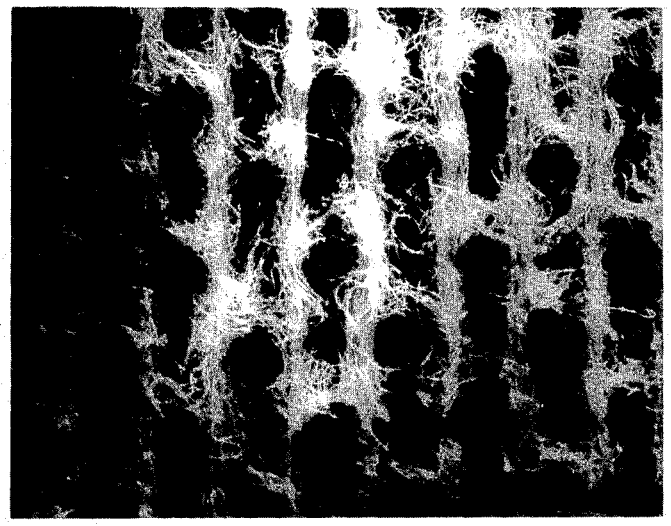
Figure 13:
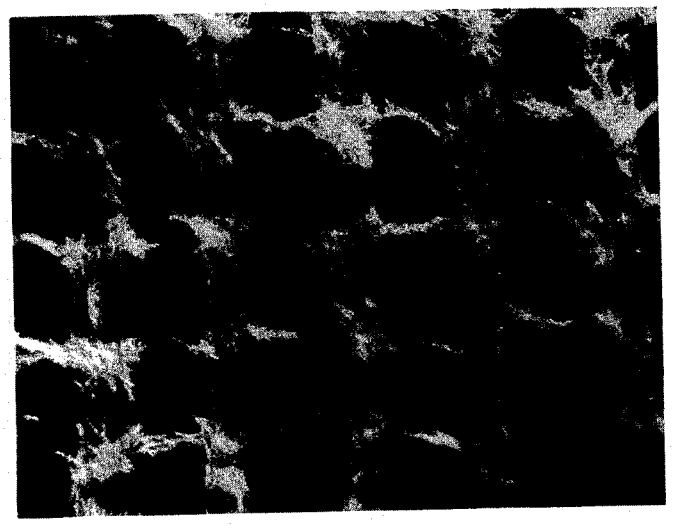
FIGS. 13 and 14 are photomacrographs of prior art fabrics taken at 10X, showing the topside and the belt side respectively, illuminated from above.
Figure 14:
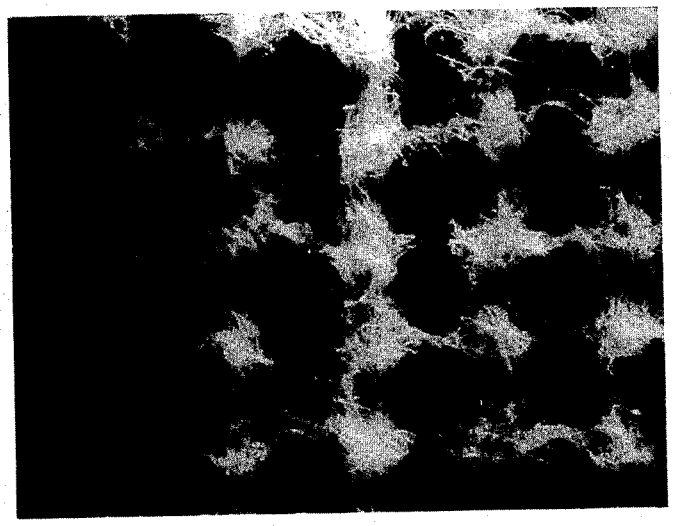

As noted in Table 2 at 50% or more rayon fiber the fabrics formed on the various belts have similar tenacities. This is believed to be due to the ease of entangling of rayon fibers. At about 75% or more polyester fibers, the fabrics of the present invention yield vastly increased machine direction and cross direction tenacity over the fabrics made on the 20×20 or the 12°12 belts. The fabrics formed on the 20×20 belt, whose tenacities are set forth in Table 2, are seen in FIGS. 11 and 12, and the fabrics formed on the 12×12 belt, whose tenacities are set forth in the table, are seen in FIGS. 13 and 14.

Figure 9:
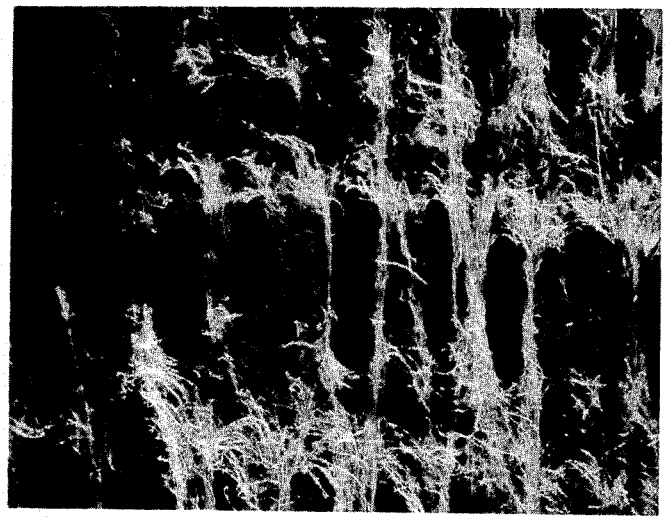
Figure 10:
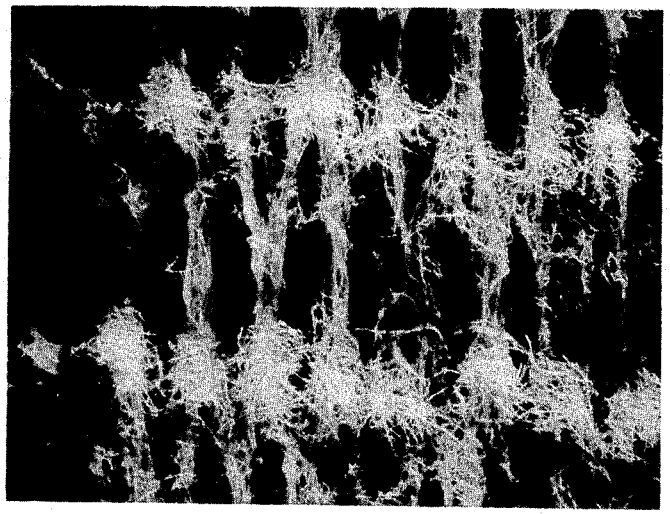

FIGS. 9 and 10 disclose another embodiment of the fabric of the present invention, formed from a 1 ounce per square yard carded web of 75% polyester, 25% rayon fibers described above. The fabric is formed on forming belt A. The fabric shown generally at 50 comprises a series of substantially parallel lines 52 of raised entangled fiber regions 54 interconnected by lightly entangled fiber regions 56, the entangled fiber regions of adjacent lines being interconnected by bundles 58 of substantially unentangled fibers. The bundles are substantially parallel to one another and substantially perpendicular to the lines of entangled regions 52. Adjacent bundles and the lines they interconnect to fine aperatures in the fabric. The tenacities of the fabric are set forth below in Table III.

The fabrics were formed on a sample machine, an apparatus smaller in scale than the apparatus used to form the fabrics depicted in FIGS. 4 through 8 and described in Tables I and II above.

TABLE III

| Fiber | Web | Belt | MD Tenacity | CD Tenacity |
|---|---|---|---|---|
| 75% PET/ 25% Rayon | Oriented | A | 1.4 | .45 |
| 75% PET/ 25% Rayon | Oriented | 20 × 20 | 0.84 | 0.25 |
| 75% PEt/ 25% Rayon | Oriented | 12 × 12 | 0.24 | 0.24 |

The fabric formed with forming belt A shows a vastly increased machine direction and cross direction tenacity when compared with fabrics formed from the similar base web on a 20×20 or 12×12 belt on the sample machine. Though the process conditions for forming the fabrics on the sample machine are the same as those for forming the fabric shown in FIGS. 4 through 8, but the slightly different apparatus provides fabrics of machine direction and cross direction tenacities which can not be directly comparred with the tenacities of fabrics made on another apparatus. However, Table 3 provides a comparision of fabrics made on forming belt A with fabrics made on 20>20 or a 12×12 belt.

It should be noted that this increase in machine direction and cross direction tenacity achieved by the fluid rearrangement/entangling of a light-weight web of fibers on the forming belt used to form the fabric of the present invention is not noted when using a random starting web. Table IV below sets forth the machine direction and cross direction tenacities of a 1 ounce per square yard fabric made from a randon web on either forming belt C or a 20×20 belt.

TABLE IV

| Fiber | Web | Belt | MD Tenacity | CD Tenacity |
|---|---|---|---|---|
| 75% PEt/ 25% Rayon | 1 oz/yd$^2$ random | C | 2.6 | 2.0 |
| 75% PET/ 25% Rayon | 1 oz/yd$^2$ random | 20 × 20 | 2.4 | 1.9 |
| 75% PET/ 25% Rayon | 2 oz/yd$^2$ random | C | 3.1 | 3.1 |
| 75% PET/ 25% Rayon | 2 oz/yd$^2$ random | 20 × 20 | 3.2 | 2.9 |

Figure 15:
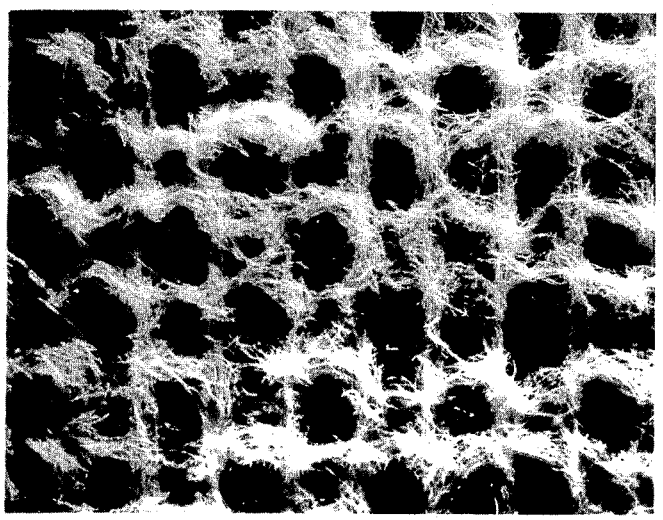
FIGS. 15 and 16 are photomacrographs of prior art fabrics taken at 10X, showing the top side and the belt side respectively, illuminated from above.
Figure 16:
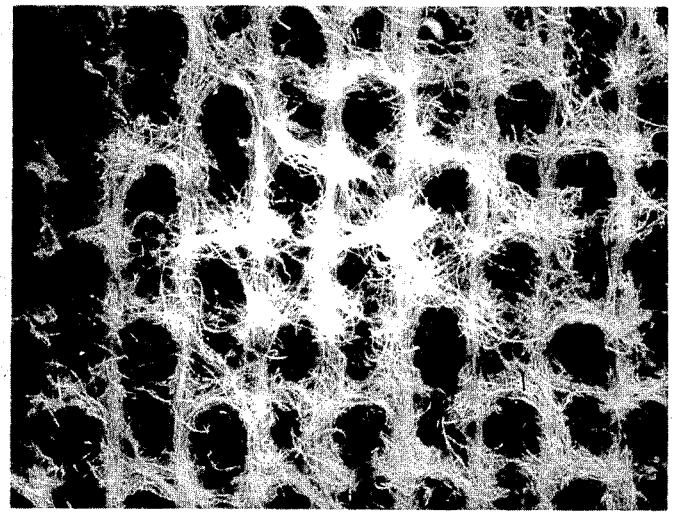

The fabrics were formed under the same process conditions, and on the same apparatus as the fabrics depicted in FIGS. 4 and 8 and described in Tables I and II. The fabric formed on the forming belt C is in fact the fabric depicted in FIGS. 7 and 8 and described in conjunction therewith. The fabric formed on the 20×20 belt with a random web is shown in FIGS. 15 and 16. As may be seen in Table IV, with a starting web of 1 ounce per square yard randon fibers, the fabrics formed on forming belt C or the 20×20 belt show similar tenacities. The tenacities of 2 ounce per square yard fabrics made from a random web of fibers on forming belt C or the 20×20 belt are also set forth in Table IV and are comparable.

As shown in Table V, below, 2 ounce per square yard fabrics formed from an oriented web of 75% polyester 25% rayon on forming belt C display the same increased machine direction and cross direction tenacities over fabrics formed on the 20×20 belt, however, the fabric formed on forming belt C displays continuous, wholly entangled ribs as claimed in U.S. Pat. No. 4,379,799.

TABLE V

| Fiber | Web | Belt | MD Tenacity | CD Tenacity |
|---|---|---|---|---|
| 75% PET/ 25% Rayon | 2 oz/yd$^2$ Oriented | C | 4.8 | .77 |
| 75% PET/ 25% Rayon | 2 oz/yd$^2$ Oriented | 20 × 20 | 2.6 | .36 |

The relative tenacities of 2 ounce per square yard webs of oriented 75% polyester 25% rayon fibers fluid rearrange/entangled on forming belts A, 20×20 and 12×12 under the same process conditions stated above, but on the sample machine are shown below in Table IV. The fabric formed on forming belt A again shows increased machine and cross direction tenacities compared to the fabrics formed on the 20×20 and 12×12 belts, but again, the fabric formed on forming belt A displays the continuous, wholly entangled ribs as claimed in U.S. Pat. No. 4,379,799.

TABLE VI

| Fiber | Web | Belt | MD Tenacity | CD Tenacity |
|---|---|---|---|---|
| 75% PET/ 25% Rayon | 2 oz/yd$^2$ Oriented | A | 2.3 | .61 |
| 75% PET/ 25% Rayon | 2 oz/yd$^2$ Oriented | 20 × 20 | 1.6 | .43 |
| 75% PET/ 25% Rayon | 2 oz/yd$^2$ Oriented | 12 × 12 | 1.4 | .41 |

Thus, it is apparent that there has been provided, in accordance with the invention, a new, light weight entangled non-woven fabric having an excellent combination of machine direction and cross direction strength. While the invention has been described in conjunction with specific embodiments thereof, it is evident that many alternatives, modifications and variations will be apparent to those skilled in the art in light of the above description. Accordingly, it is intended to embrace all such alternatives, modifications and variations that fall within the spirit and broad scope of the appended claims.

What is claimed is:

1. An entangled non-woven fabric comprising at least about 75% polyester staple fibers, said fibers being arranged in a repeating pattern of spaced parallel lines of raised entangled regions interconnected by partially entangled fiber arrays, said lines extending in one fabric direction, and spaced bundles of straight substantially parallel fiber segments interconnecting the entangled regions of adjacent lines, said bundles being substantially parallel to one another and substantially perpendicular to said line, adjacent bundle and said lines defining aperatures therebetween.

2. The fabric of claim 1 having a basis weight of from 0.3 to 1.5 oz/yd$^2$.

3. The fabric of claim 1 or claim 2 comprising 75% polyester staple fibers and 25% rayon staple fibers.

4. The fabric of claim 1 having a basis weight of 1.0 oz/yd$^2$.

5. A process for producing a light weight nonwoven fabric having excellent strength in both the machine direction and cross direction comprises:

(a) supporting a layer of fibers comprising at least 75% polyester fibers, having a basis weight of from about 0.3 to 1.5 oz/yd$^2$, on a liquid pervious support member adapted to move in a predetermined machine direction and on which fiber movement in directions both in and at an angle to the plane of said layer is permitted in response to applied liquid forces, the fibers of said layer being oriented in said predetermined direction, and said support member having alternating liquid impervious deflecting zones and liquid pervious entangling zones extending transversely to said predetermined direction, or in the cross direction, said entangling zones being substantially free of raised deflecting means, and said deflecting zones including spaced deflecting means adapted to deflect liquid in a direction transverse to said predetermined direction;

(b) moving the supported layer in said predetermined direction through a fiber rearranging zone within which streams of high pressure, fine, essentially columnar jets of liquid are projected directly onto said layer; and (c) passing said streams of liquid through said layer and said support member in said fiber rearranging zone to effect movement of fibers such that (1) spaced bundles of straight, substantially parallel fiber segments are formed in said deflecting zones, said bundles being oriented generally in said predetermined direction, (2) spaced parallel lines of raised entangled fiber regions interconnected by partially entangled fiber arrays are formed in said entangling zones, and lines extending in a direction transverse to said predetermined direction, and (3) said spaced bundles interconnect said entangled regions and are locked into said entangled regions the ends of said bundles by fiber entanglement.

* * * * *